US006450422B1

(12) United States Patent
Maggio

(10) Patent No.: US 6,450,422 B1
(45) Date of Patent: Sep. 17, 2002

(54) SPRAY GUN

(76) Inventor: Richard A. Maggio, 27191 Shenandoah Dr., Laguna Hills, CA (US) 92653

( * ) Notice: Subject to any disclaimer, the term of this patent is extended or adjusted under 35 U.S.C. 154(b) by 54 days.

(21) Appl. No.: 09/656,483

(22) Filed: Sep. 7, 2000

(51) Int. Cl.[7] ..... B05B 7/30
(52) U.S. Cl. ..... 239/345; 239/377; 239/379
(58) Field of Search ..... 239/318, 379, 239/345, 346, 347, 307, 375, 390, 377

(56) References Cited

U.S. PATENT DOCUMENTS

| | | | | | |
|---|---|---|---|---|---|
| 3,236,459 | A | * | 2/1966 | McRitchie | 239/416 |
| 3,907,205 | A | * | 9/1975 | Shreve | 239/307 |
| 5,366,158 | A | * | 11/1994 | Robisch et al. | 239/346 |
| 5,454,517 | A | * | 10/1995 | Naemura | 239/390 |
| 5,803,360 | A | * | 9/1998 | Spitznagel | 239/345 |
| 5,810,258 | A | * | 9/1998 | Wu | 239/346 |
| 5,875,971 | A | * | 3/1999 | Morck | 239/345 |
| 5,918,815 | A | * | 7/1999 | Wu | 239/345 |
| 5,961,050 | A | * | 10/1999 | Kitajima | 239/346 |
| 6,012,651 | A | * | 1/2000 | Spitznagel | 239/345 |
| 6,019,294 | A | * | 2/2000 | Anderson et al. | 239/375 |
| 6,092,740 | A | * | 7/2000 | Liu | 239/346 |
| 6,213,410 | B1 | * | 4/2001 | Spitznagel | 239/345 |

OTHER PUBLICATIONS

Superior Featherweight Tools Company, Inc., Drywall Tools Buyer Guide, cover page and p. 6.

EZ–TEX flyer—state of the art texture coating spray gun.

* cited by examiner

*Primary Examiner*—Lesley D. Morris
*Assistant Examiner*—Dinh Q. Nguyen
(74) *Attorney, Agent, or Firm*—Harold L. Jackson

(57) ABSTRACT

A spray gun adapted for applying a texturized coating material includes a housing with a mounting block extending forwardly of a pistol grip. A longitudinal bore extends through the housing and mounting block. A carrier fluid, (e.g., air) delivery tube having an inlet and an outlet orifice, is positioned within the longitudinal bore, and extends beyond the end of the mounting block. A coating material/interface member is rotatably mounted on the mounting block with an axial bore therein surrounding the delivery tube. A nozzle, carried by the forward end of the interface member, is positioned adjacent to the outlet orifice. The interface member has a coating material inlet nipple extending outwardly and preferably rearwardly at an acute angle to the axial bore. The rotatable mounting of the interface member allows the coupling end of a line transporting the coating material to be positioned above or below the interface member.

11 Claims, 4 Drawing Sheets

SPRAY GUN

FIELD OF THE INVENTION

The present invention relates to spray guns and more particularly to hand held sprayers adapted for spraying texturizing material onto surfaces such as ceilings, walls, floors, etc.

BACKGROUND OF THE INVENTION

State of the art spray texturizing systems typically employ a hand held gun which utilizes a carrier fluid such as air from a pressurized source to entrain a synthetic material such as drywall texturing mud or ceiling material. The systems include a housing in the form of a pistol grip at the rearward portion and a material dispersing bowl at the forward end terminating in a nozzle. An air delivery tube slidably mounted in the housing delivers a high velocity air stream to the nozzle via an air duct in the handle. A conventional compressor supplies the air to the handle air duct via a flexible line. The material dispensing bowl is in the form of an elbow with the nozzle positioned at the forward end, an opening opposite the forward end for receiving the air delivery tube and a right angle extension through which the texturizing material is pumped (or flows by gravity) from a reservoir.

The state of the art texturizing spray guns have several shortcomings. First, the flexible line or conduit extending from the pump to the spray gun, when full of the material to be sprayed, is heavy. The weight of the filled line from floor level to the hand gun level is burdensome and particularly so when surfaces to be coated are above the operator's head are to be coated. A gravity feed system, where the reservoir of texturizing material is carried by the gun, like the line fed system, presents a tiring load on a operator's arm and hand holding the gun. In addition the gravity feed systems are not conducive for overhead spraying.

Second, the ninety degree (90°) angle between the material extension and the air flow path seems to impede the smooth flow of material through the nozzle.

There is a need for a hand held spray gun adapted to apply texturizing and other coating material which overcomes the above shortcomings.

SUMMARY OF THE INVENTION

A spray gun adapted for applying texturized coatings, in accordance with the present invention, includes a housing having an upper portion terminating at its forward end in a mounting block with a longitudinal bore extending therethrough. The lower portion of the housing forms a pistol grip with a carrier fluid (e.g., air) passageway therein extending from an inlet port at the lower end to the longitudinal bore. A carrier fluid delivery tube is positioned within the housing's longitudinal bore with the distal end of the tube extending beyond the mounting block and terminating in a discharge orifice. The proximal end of the delivery tube is in fluid communication with the carrier fluid passageway.

A coating material/carrier fluid interface member is rotatably mounted on the mounting block and comprises a central section with an axial bore aligned with the longitudinal bore and surrounding the distal end of the deliver tube with the outlet orifice disposed adjacent the forward end of the interface member.

The interface member further includes a material inlet nipple extending outwardly from the central section along an axis which intersects the axis of the longitudinal bore. The inlet nipple defines a material inlet chamber which is in fluid communication with an aspiration chamber within the central section of the interface member. Preferably the material inlet chamber intersects the longitudinal bore at an acute angle to enhance the flow of coating material into the air stream exiting the delivery tube outlet orifice. A nozzle is secured to the forward end of the interface member to provide a desired output spray pattern of the coating material/carrier fluid.

The interface member may be rotated relative to the housing to a desired position to accommodate a material feed line extending downwardly from the gun or a line extending upwardly from the gun and supported, for example, by the operator's shoulder and back. As an optional feature a swivel joint coupling may be used to connect the air line to the housing inlet port so that the air line as well as the coating material feed line can be positioned over the operator's shoulder.

DESCRIPTION OF THE PREFERRED EMBODIMENTS

Figure 1:
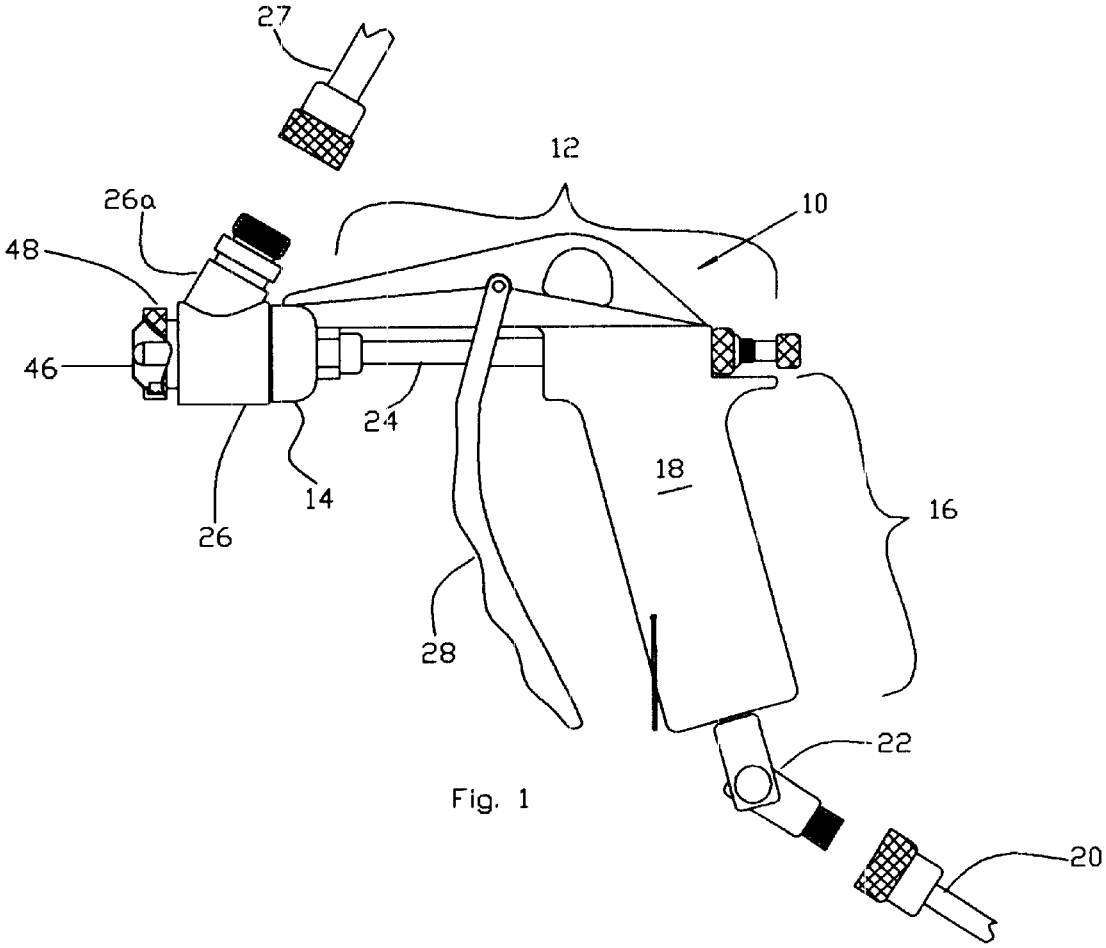
FIG. 1 is a side elevational view of a spray gun in accordance with the present invention with the coating material/carrier fluid interface member rotated to position the material inlet nipple above the gun.
Figure 2:
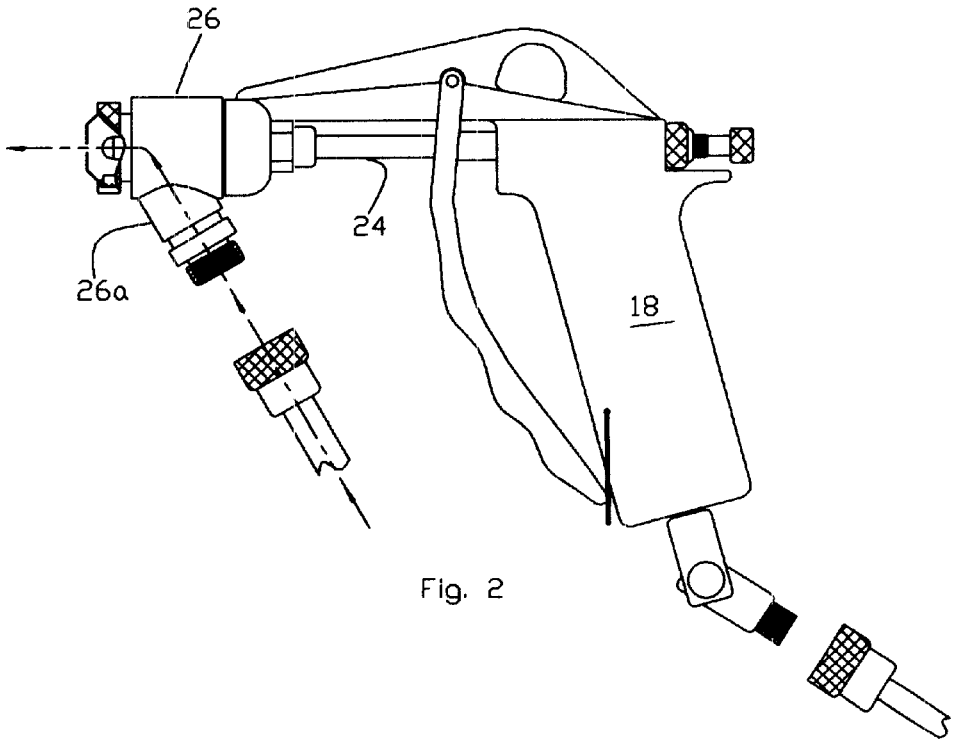
FIG. 2 is a side elevational view of the spray gun of FIG. 1 with the interface member rotated to position the nipple in a downward position.

Referring now to FIGS. 1 and 2, a spray gun, in accordance with the present invention, includes a housing 10 having an upper portion or section 12 terminating at its forward end in a mounting block 14 and a lower portion or section 16 in the form of a pistol grip 18.

A carrier fluid line 20 is connected to inlet port 21 (FIGS. 1 and 3) in the lower housing section via a swivel joint coupling 22. A carrier fluid delivery tube 24 extends through a longitudinal bore (to be described) within the upper housing portion including the mounting block and extends into an axial bore (to be described) in a coating material/carrier fluid interface member (or material receiving bowl) 26. The interface member, which is rotatably mounted on the mounting block, includes a main section 26*a* and a material inlet nipple 26*b* extending outwardly therefrom. The nipple is adapted to be connected to a coating material feed line 27 which receives the material from a reservoir and pump (to be described in connection with FIG. 8). As will be described in more detail carrier fluid, such as air, from a pressurized source entrains the coating material adjacent the interface outlet and provides an output spray pattern of the material via a conventional nozzle 46 held in place by a knurled nut 48. A manually operated trigger 28 is arranged to move the delivery tube 24 rearwardly a short distance from the nozzle to expose the coating material to the carrier fluid stream issuing from the outlet orifice to commence the spraying operation. See FIG. 2.

Figure 8:
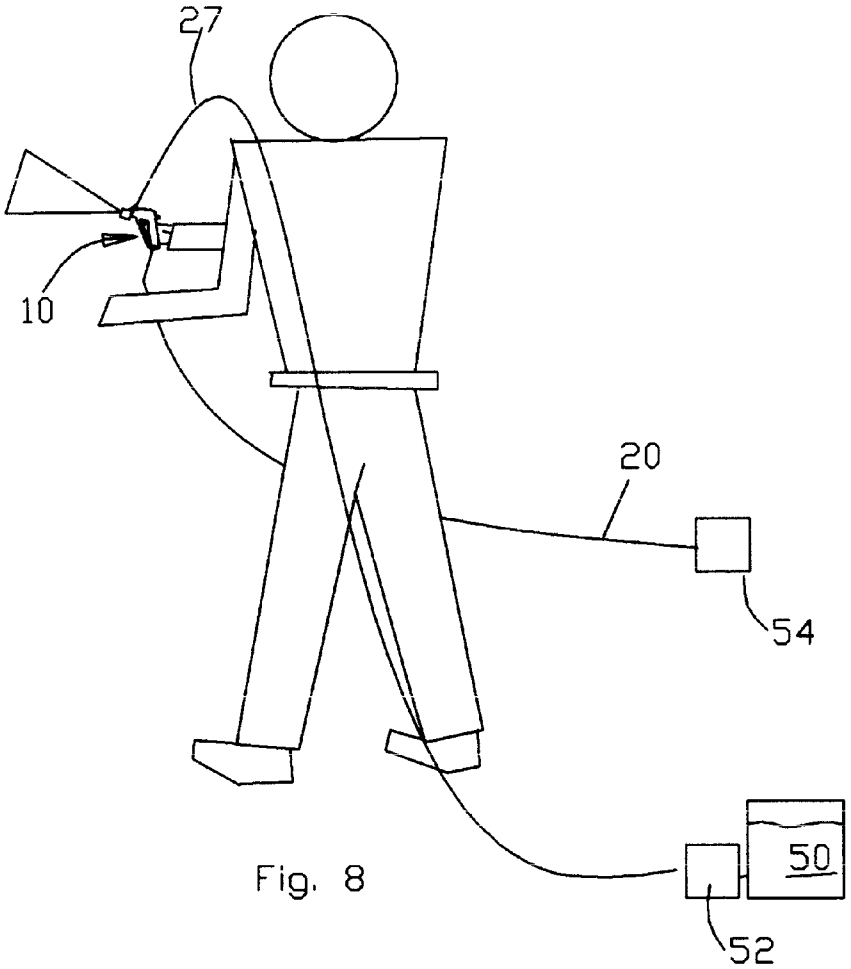
FIG. 8 is a diagrammatic view of an operator holding the spray gun with the coating material line suspended over the shoulder.

The inlet nipple 26*b* is directed upwardly in FIG. 1 to receive the line 28 positioned, for example, over an operator's shoulder as is illustrated in FIG. 8.

In FIG. 2 the interface member 26 has been rotated to direct the inlet nipple in a downward direction; a conventional configuration.

Figure 3:
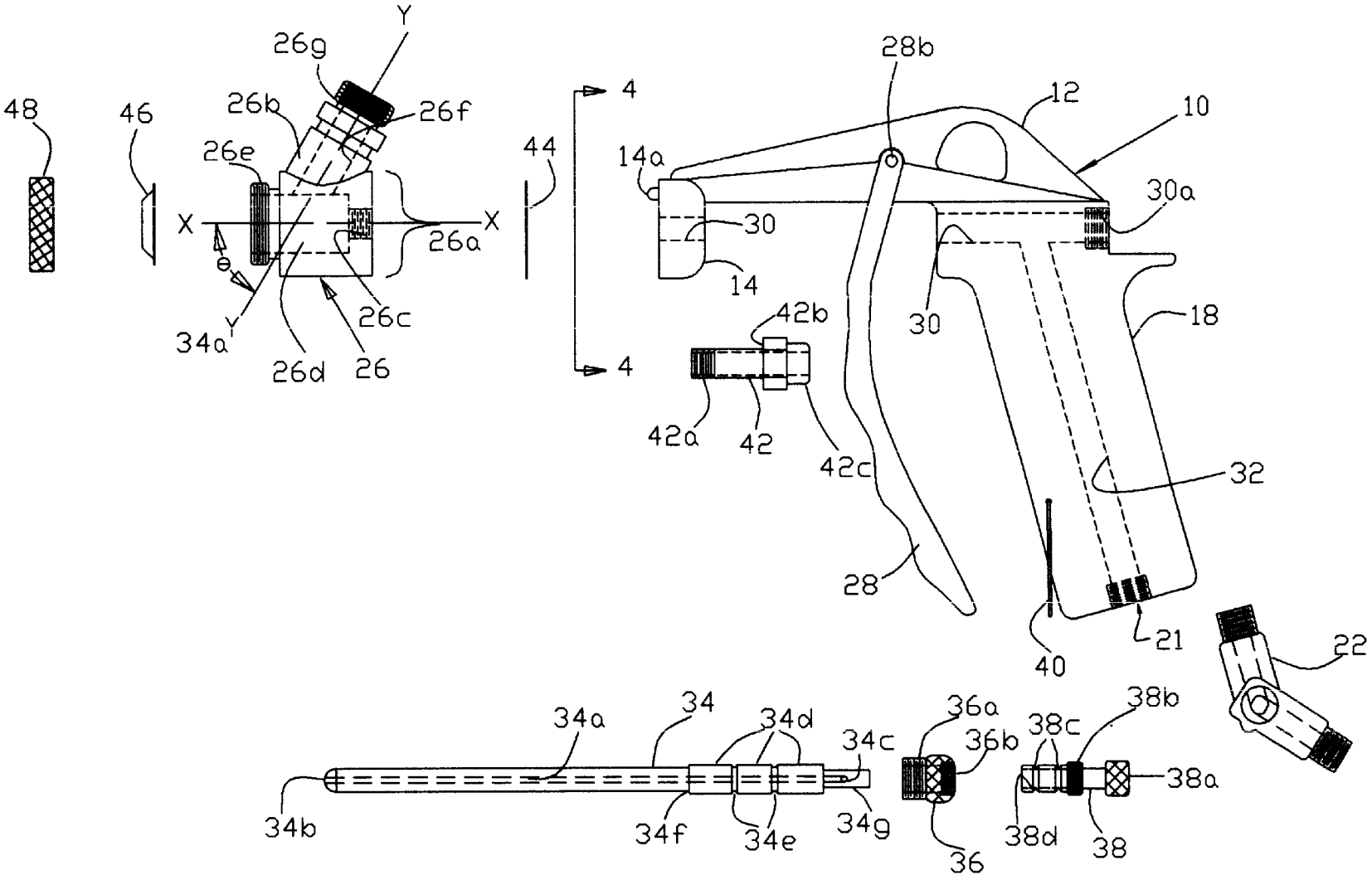
FIG. 3 is a exploded view of the spray gun of FIG. 1, disassembled, showing the constituent components thereof.

Referring now to FIG. 3, the upper section of the gun housing includes a longitudinal bore 30 which intersects a carrier fluid duct 32 disposed in the lower housing section. A carrier fluid delivery tube 34 is positioned within the longitudinal bore and extends through the mounting block 14. A guide bushing 36 includes external threads 36*a* for engaging the internal threads 30*a* at the rearward end of the bore 30. A material adjustment control rod 38 includes a manually operable knob 38*a* and an externally thread section 38*b* for cooperating with an internally threaded portion 36*b* of the bushing 36. The adjustment rod 38 further includes annular grooves 38*c*, for retaining o-rings (not shown) to seal the rearward end of the bore 30, and blind bore 38*d* which receives the reduced diameter stub end 34*g* of the delivery tube. A bias spring (not shown) inside the blind bore engages the rearward end of the delivery tube 34 to bias the tube against the nozzle 46 as is shown in FIG. 1. The linear position of the adjustment knob relative to the housing controls the quantity of the material sprayed per unit of time in a manner well known to those skilled in the art.

The carrier fluid delivery tube 34 defines a carrier passageway 34*a* which extends from an outlet orifice 34*b* at its proximal end to a lateral duct 34*c* which opens into the interior of the bore 30 adjacent the duct 32 in the handle. The tube 34 includes lands 34*d* separated by grooves 34*e* which receive O-rings (not shown) for sealingly engaging the inner wall of bore 30 above the handle section. The shoulder 34*f* formed by the forward land is engaged by a yoke 28*a* (FIG. 4) formed in the trigger 28 when the trigger is rotated about pivot pin 28*b* toward the handle 18 to move the end of the delivery tube away from the nozzle 46. A latch 41 (pivotally mounted to the handle) serves to hold the trigger in the actuated condition.

An interface member retaining sleeve 42 is provided with external threads 42*a* which mate with threads 26*c* at the rearward end of the interface member 26 to secure the member 26 (and a gasket 44) in a desired rotational position against the mounting member 14. The sleeve 42 includes a shoulder 42*b* which limits the forward insertion of the sleeve in the bore 30 of the mounting member and a hexagonal wrench engaging surface 42*c*.

The interface member 26 defines a stepped axial bore concentric to axis x—x which expands in diameter from the threaded end 26*c* to a larger diameter to form an aspiration chamber 26*d* surrounding the delivery tube 34. The interface member is provided with an externally threaded forward end 26*e* against which a nozzle 46 is secured via a knurled annular nut 48.

Figure 4:
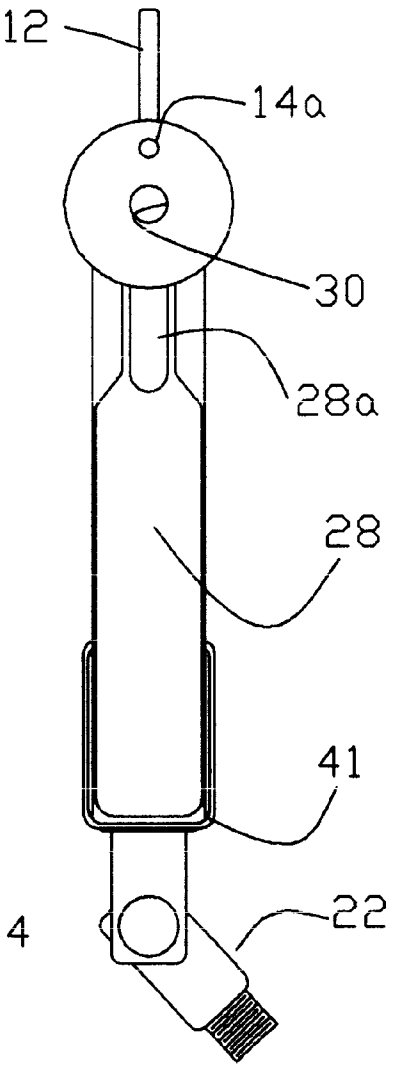
FIG. 4 is a front elevational view of the spray gun, viewed along lines 4—4 of FIG. 3.

The coating material inlet nipple 26*b* defines a material inlet passageway or chamber 26*f*, circular in cross-section, (terminating at its free end in external threads 26*g*) concentric with an inclined axis y—y. The axis y—y preferably intersects the axis x—x at an acute angle O of about 6° with the nipple extending rearwardly as illustrated. This inclination enhances the flow of coating material into the air stream exiting the discharge orifice 34*b*. FIG. 4, a rearward looking view of the unassembled gun (except for the coupling 22), illustrates the yoke portion 28*a* of the trigger.

Figure 5:
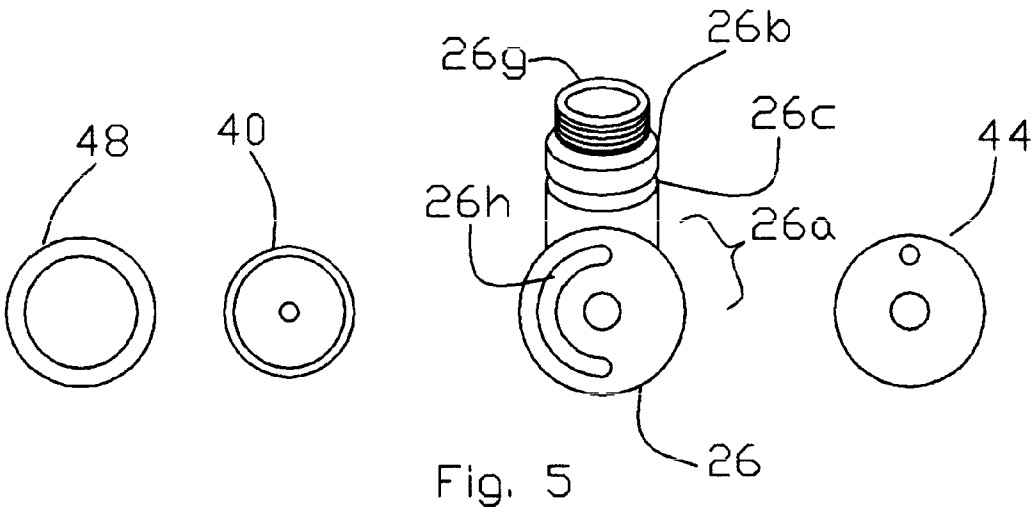
FIG. 5 is a rear elevational view of the interface member and associated components accommodating only an 180° rotation.

Referring now to FIG. 5, a rear view of the interface member 26 and associated parts, the interface member main section 26*a* includes a semicircular (i.e., 180°) groove 26*h* on the rear face thereof. This groove mates with a protruding pin 14*a* on the front face of the mounting block 14 to limit the allowable rotation of the interface member to 180°, i.e., in an up or down direction.

Figure 6:
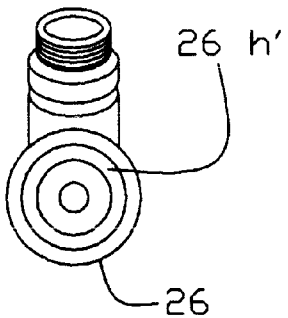
FIG. 6 is a rear elevational view of an alternate embodiment of the interface member accommodating a 360° rotation.

FIG. 6 illustrates, via a rear view, an alternative embodiment of the interface member. In this embodiment the annular groove 26*h*' is continuous to enable the operator to select any desired rotational position of the member 26.

Figure 7:
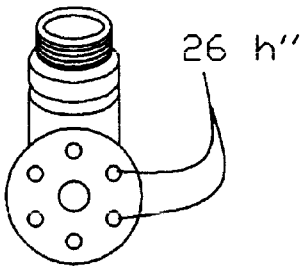
FIG. 7 is a rear elevational view of another embodiment of the interface member accommodating an indexed rotational movement.

FIG. 7 illustrates, via a rear view, a further embodiment of the interface member wherein the annular groove 26*h* is replaced by a plurality of blind bore 26*h*", one of which is arranged to mate with the mounting block pin 14*a* to provide an indexing arrangement, i.e., allowing the operator to select one of six possible rotational positions for the member 26.

FIG. 8 illustrates the use of the spray gun 10 in which the interface member is rotated in the position shown in FIG. 1 with the coating material line positioned over the operator's shoulder so that his or her shoulders and back bear the brunt of the weight of the line. The coating material, which may be a conventional texturizing material, is fed to the spray gun 10 from a material reservoir or hopper 50 via a pump 52. The carrier fluid such as air is supplied to the gun from a conventional compressor 54. It is to be noted that the inlet end of the swivel joint coupling 22 may be rotated relative to the handle to allow the carrier fluid or air line to also be positioned over the operator's shoulder. An on/off valve (not shown) may be connected in the carrier fluid line, preferably adjacent the housing handle to allow the operator to control the flow of carrier fluid.

There has thus been described a versatile spray gun particularly adapted for spraying texturizing material on surfaces such as ceilings, floors and dry walls. Modifications and improvements of the spray gun may become apparent to those skilled in the art without involving a departure from the spirit and scope of the invention as defined by the appended claims.

What is claimed is:

1. A spray gun adapted for applying a texturized coating comprising:

a housing having an upper portion terminating at a forward end in a mounting block member and a lower portion forming a pistol grip, the upper portion defining a longitudinal bore therethrough, the lower portion defining a carrier fluid passageway intersecting the longitudinal bore at its upper end and terminating in a carrier fluid inlet port at its lower end;

a carrier fluid delivery tube positioned within the longitudinal bore of the housing, the delivery tube having a distal end extending beyond the end of the mounting block member and having an inlet adjacent its proximal end in fluid communication with the carrier fluid passageway in the house lower portion and an outlet orifice at is distal end;

a coating material/carrier fluid interface member having a central section defining an axial bore which forms an aspiration chamber at the forward end thereof and a material inlet nipple extending outwardly from the central section and defining a coating material inlet chamber in fluid communication with the aspiration chamber, the interface member being rotatably mounted on the mounting block member with the axial bore aligned with the longitudinal bore in the housing, the distal end of the delivery tube extending into the axial bore with the outlet orifice disposed adjacent the forward end thereof;

a nozzle secured to the forward end of the interface member whereby carrier fluid exiting the outlet orifice entrains texture material in a spray pattern; and cooperating means disposed on the rearward end of the interface member and the forward end of the mounting block member to limit the rotational movement of the interface member relative to the mounting block member to an arc of about 180°, The cooperating means comprising a protruding pin and a cooperating groove with the pin located on one of the mounting block and interface members and the groove located on the other member.

2. The spray gun of claim 1 wherein the material inlet nipple extends along an axis that is inclined rearwardly at an acute angle θ to the axis of the longitudinal bore.

3. The spray gun of claim 2 wherein the angle θ is about 60°.

4. The spray gun of claim 1 further including a swivel joint fluid coupling connected to the carrier fluid port.

5. A texture coating spray gun comprising:

a housing having a upper portion terminating at a forward end in a mounting block and a downwardly extending portion forming a pistol grip, the upper portion defining a longitudinal bore extending therethrough, the pistol grip defining a carrier fluid passageway intersecting the longitudinal bore at its upper end and terminating in a carrier fluid inlet port at a position below the longitudinal bore;

a fluid delivery tube positioned within the longitudinal bore of the housing, the delivery tube having a distal end extending beyond the end of the mounting block and a proximal end disposed adjacent the intersection of the longitudinal bore and the carrier fluid passageway, the fluid delivery tube having an inlet adjacent its proximal end in fluid communication with the carrier fluid passageway in the pistol grip and an outlet orifice at is distal end;

a material receiving bowl rotatably mounted on the mounting block so that the bowl can be rotated through an arc of about 180°, the bowl defining an axial bore therethrough aligned with the longitudinal bore in the housing, the bowl having a material inlet nipple extending outwardly from the axial bore and defining a material passageway in fluid communication with the axial bore, the distal end of the fluid delivery tube extending into the bore with the outlet orifice disposed adjacent the free end of the axial bore, the axial bore defining an aspiration chamber adjacent the outlet orifice of the delivery tube the material receiving bowl being arranged to extend upwardly in one rotational position and extend downwardly in another rotational position of the bowl; and a nozzle secured to the material receiving bowl adjacent the outlet orifice of the delivery tube.

6. The spray gun of claim 5 including cooperating means disposed on the rearward end of the material receiving bowl and the forward end of the mounting block to limit the rotational movement of the material receiving bowl relative to the mounting member.

7. The spray gun of claim 6 wherein the mounting block and the interface member have front and rear faces, respectively and wherein cooperating means comprises a protruding pin on one of the faces and a groove in the other face.

8. The spray gun of claim 6 further including a swivel joint fluid coupling connected to the carrier fluid port.

9. The spray gun of claim 5 wherein the material inlet nipple extends along an axis that is inclined rearwardly to an acute angle θ of about 60° to the axis of the longitudinal bore.

10. A coating material spray gun system comprising:

a pressurized source of coating material;

a pressurized source of carrier fluid;

a housing having a mounting block at a forward end and a downwardly extending pistol grip at the rearward end, the mounting block defining a longitudinal bore therethrough;

a material receiving bowl having a central section defining an axial bore terminating in an outlet and a material inlet nipple extending outwardly from the central section, the inlet nipple having an inlet port connected to the pressurized source of coating material, the material receiving bowl being rotatably mounted on the mounting block with its axial bore aligned with the longitudinal bore of the mounting block whereby the material inlet nipple may be positioned above or below the mounting block axial bore;

a carrier fluid tube carried by the mounting block and having a proximal end in fluid communication with the pressurize source of carrier fluid and a distal end and extending into the axial bore of the receiving bowl and terminating in an outlet orifice adjacent the bowl outlet; and a nozzle secured to the bowl outlet downstream of the carrier fluid tube outlet orifice.

11. A spray gun adapted for applying a texturized coating comprising:

a housing having an upper portion terminating at a forward end in a mounting block member and a lower portion forming a pistol grip, the upper portion defining a longitudinal bore therethrough, the lower portion defining a carrier fluid passageway intersecting the longitudinal bore at its upper end and terminating in a carrier fluid inlet port at its lower end;

a carrier fluid delivery tube positioned within the longitudinal bore of the housing, the delivery tube having a distal end extending beyond the end of the mounting block and having an inlet adjacent its proximal end in fluid communication with the carrier fluid passageway in the house lower portion and an outlet orifice at is distal end;

a coating material/carrier fluid interface member having a central section defining an axial bore which forms an aspiration chamber at the forward end thereof and a material inlet nipple extending outwardly from the central section and defining a coating material inlet chamber in fluid communication with the aspiration chamber, the interface member being rotatably mounted on the mounting block member with the axial bore aligned with the longitudinal bore in the housing, the distal end of the delivery tube extending into the axial bore with the outlet orifice disposed adjacent the forward end thereof;

a nozzle secured to the forward end of the interface member whereby carrier fluid exiting the outlet orifice entrains texture material in a spray pattern; and cooperating indexing means disposed on the rearward end of the interface member and the forward end of the mounting block member to allow rotational movement of the interface member in increments of 20 or more degrees.

* * * * *

UNITED STATES PATENT AND TRADEMARK OFFICE

CERTIFICATE OF CORRECTION

PATENT NO. : 6,450,422 B1
DATED : September 17, 2002
INVENTOR(S) : Richard A. Maggio It is certified that error appears in the above-identified patent and that said Letters Patent is hereby corrected as shown below:

Column 3,
Line 65, "6º" should read -- 60º --.

Signed and Sealed this

Twenty-fifth Day of February, 2003

JAMES E. ROGAN
*Director of the United States Patent and Trademark Office*